United States Patent [19]

Zajic

[11] Patent Number: 4,531,377

[45] Date of Patent: Jul. 30, 1985

[54] TEMPERATURE CONTROL APPARATUS FOR MOUNTING IN A TRANSPORTABLE BODY

[75] Inventor: Albert H. Zajic, Oklahoma City, Okla.

[73] Assignee: American Trailers, Incorporated, Oklahoma City, Okla.

[21] Appl. No.: 520,174

[22] Filed: Aug. 4, 1983

[51] Int. Cl.[3] ..... F25D 17/04

[52] U.S. Cl. ..... 62/187; 62/239; 62/440

[58] Field of Search ..... 62/186, 187, 239, 440

[56] References Cited

U.S. PATENT DOCUMENTS

| | | | |
|---|---|---|---|
| 2,275,721 | 3/1942 | Bonsall | 62/239 |
| 2,633,714 | 4/1953 | Wehby | 62/239 |
| 2,677,244 | 5/1954 | Wehby | 62/239 |
| 2,677,246 | 5/1954 | Wehby | 62/239 |
| 2,780,923 | 2/1957 | Jones | 62/239 |
| 3,057,284 | 10/1962 | Learmont | 62/239 |
| 3,175,606 | 3/1965 | Talmey et al. | 62/239 |
| 3,216,216 | 11/1965 | Rowley | 62/239 |
| 3,246,592 | 4/1966 | Rath | 62/239 |
| 3,362,179 | 1/1968 | Kirkpatrick | 62/239 |
| 3,411,312 | 11/1968 | Sigl et al. | 62/187 |
| 3,486,241 | 12/1969 | Coyle et al. | 62/239 |
| 3,625,022 | 12/1971 | Johnson | 62/186 |
| 4,009,589 | 3/1977 | Webb et al. | 62/187 |
| 4,250,956 | 2/1981 | Ohtani | 62/239 |
| 4,320,628 | 3/1982 | Okajima | 62/186 |

OTHER PUBLICATIONS

Polar American advertisement pertaining to the Super Grocer (2 drawings).

*Primary Examiner*—Ronald C. Capossela

*Attorney, Agent, or Firm*—E. Harrison Gilbert, III

[57] ABSTRACT

A temperature control apparatus for mounting in a transportable body includes a false ceiling having a plurality of ducts defined therethrough. The ducts extend through a single compartment or between two or more compartments when such two or more compartments are defined within the transportable body. A shutter mechanism controls the flow of temperature-treated air flowing between compartments, thereby controlling the temperature in the various compartments. To provide a flow of temperature-treated air into the apparatus, the apparatus includes an air channeling structure which can be adjusted to divert different quantities of air into the apparatus.

16 Claims, 4 Drawing Figures

TEMPERATURE CONTROL APPARATUS FOR MOUNTING IN A TRANSPORTABLE BODY

BACKGROUND OF THE INVENTION

This invention relates generally to appartus for providing temperature control to a transportable body and more particularly, but not by way of limitation, to a ducted false ceiling having baffling and damper means for controllably transferring temperature-treated air to various compartments within a transportable body, such as a semitrailer or a truck body.

In the food industry many different types of food products, such as frozen foods and dairy products, general dairy products, packaged meats, and produce, as well as canned and packaged products, are frequently transported in a single trailer or truck body. When different types of products are carried in a single transportable body, each type is generally placed in its own compartment within the transportable body. Because of the different types of products, a different temperature is often to be maintained in each compartment to insure that each type is properly preserved. Therefore, there is the general need for some type of apparatus which can be placed in a transportable body to provide different temperatures, as desired, in each compartment.

Several types of equipment have been used in the past to refrigerate or heat the air within a compartmented transportable body. However, these types have generally been built into the transportable body as an integral part thereof so that they cannot be removed without disassembling the body. Such integral types also cannot be added to old transportable bodies. Therefore, there is the more particular need for a temperature control apparatus which can be added to a transportable body either during its manufacture or after it has been manufactured.

Because many transportable bodies have mechanical refrigeration and heating systems for generally providing cooled or heated air within the body, there is the need for the temperature control apparatus to be compatible with such systems. In other words, the temperature control apparatus should be able to provide different temperatures for different compartments from a single source of mechanically refrigerated or heated air.

It is also desirable that the temperature control apparatus be constructed for more efficiently distributing refrigerated or heated air even when the transportable body is configured as a single compartment. The apparatus is also to be constructed with a relatively smooth surface so that more efficient sealing of a movable or removable partition can be effected within the transportable body when more than one compartment is defined therein.

Because the products which are to be transported in the transportable body are often stacked throughout the entire volume of the transportable body, the temperature control apparatus should also be constructed to prevent those products which come in contact with the apparatus from freezing when one compartment is to be maintained at a freezing or subfreezing temperature and an adjacent or other compartment is to be maintained at a temperature above freezing.

To insure accurate control of the temperatures in each compartment, the temperature control apparatus should also include temperature sensing means for sensing at least one temperature and appropriately controlling the apparatus to provide the proper amount of temperature-treated air to the respective compartments. This temperature-treated air is to be provided by a known type of mechanical refrigeration and heating unit, for example, and is to be recycled through the compartment into which the unit disperses the temperature-treated air. The temperature control apparatus should include suitable air channeling means for adequately receiving a selectable quantity of the temperature-treated air.

Furthermore, it is desirable that the temperature control apparatus be constructed to require a minimum amount of space so that the load space for cargo is not significantly reduced when the temperature control apparatus is installed in the transportable body.

SUMMARY OF THE INVENTION

The present invention meets the aforementioned needs by providing a novel and improved temperature control apparatus which can be mounted in a transportable body either during manufacture of the transportable body or at a time after manufacture of the body.

The present invention can sense at least one temperature and, in response thereto, provide temperature-treated air to the various compartments in appropriate quantities to maintain selected temperatures. This temperature control is even efficiently performed when the transportable body is configured as a single compartment.

The present invention is constructed so that it has a smooth undersurface which permits efficient sealing with a movable or removable partition which can be used to separate two compartments. The present invention is also constructed to operate with conventional mechanical sources of refrigerated and heated air; however, the present invention is not limited to use with such mechanical sources. Air is returned through the present invention to such sources so that the air can be recycled. Appropriate quantities of temperature-treated air are received into the present invention through an air channeling means which insures proper temperature and air flow control.

The present invention includes an insulated surface which prevents commodities in one compartment from being frozen when they are in contact with the insulated surface even though an adjacent compartment is being maintained by the present invention at a freezing or subfreezing temperature.

The present invention is also constructed so that it requires only a small amount of space, thereby preventing any great reduction of usable cargo space within the transportable body in which the present invention can be mounted.

Broadly, the present invention provides an apparatus for providing temperature control to one or more compartments of a transportable body having means for providing temperature-treated air to the interior of the transportable body. The apparatus includes false ceiling means for providing a first passageway and a second passageway between a first one of the compartments and a second one of the compartments when the present invention is used with two compartments. The present invention also includes passageway control means, associated with an end of the first passageway which is disposed in the first one of the compartments when the false ceiling means is mounted in the transportable body, for controlling the introduction of the temperature-treated air into the first passageway. The present invention still further comprises air channeling means for channeling at least a portion of the temperature-treated air to the passageway control means. The passageway control means includes temperature-responsive means for closing the first passageway to the temperature-treated air when a predetermined temperature is detected in the second passageway.

From the foregoing it is a general object of the present invention to provide a novel and improved temperature control apparatus for mounting in a transportable body. Other and further objects, features and advantages of the present invention will be readily apparent to those skilled in the art when the following description of the preferred embodiment is read in conjunction with the accompanying drawings.

BRIEF DESCRIPTION OF THE DRAWINGS

FIG. 3 is a bottom plan view of the present invention mounted in the semitrailer which is illustrated in partial section, which view is taken as indicated by the line 3—3 shown in FIG. 1.

DETAILED DESCRIPTION OF THE PREFERRED EMBODIMENT

Figure 1:
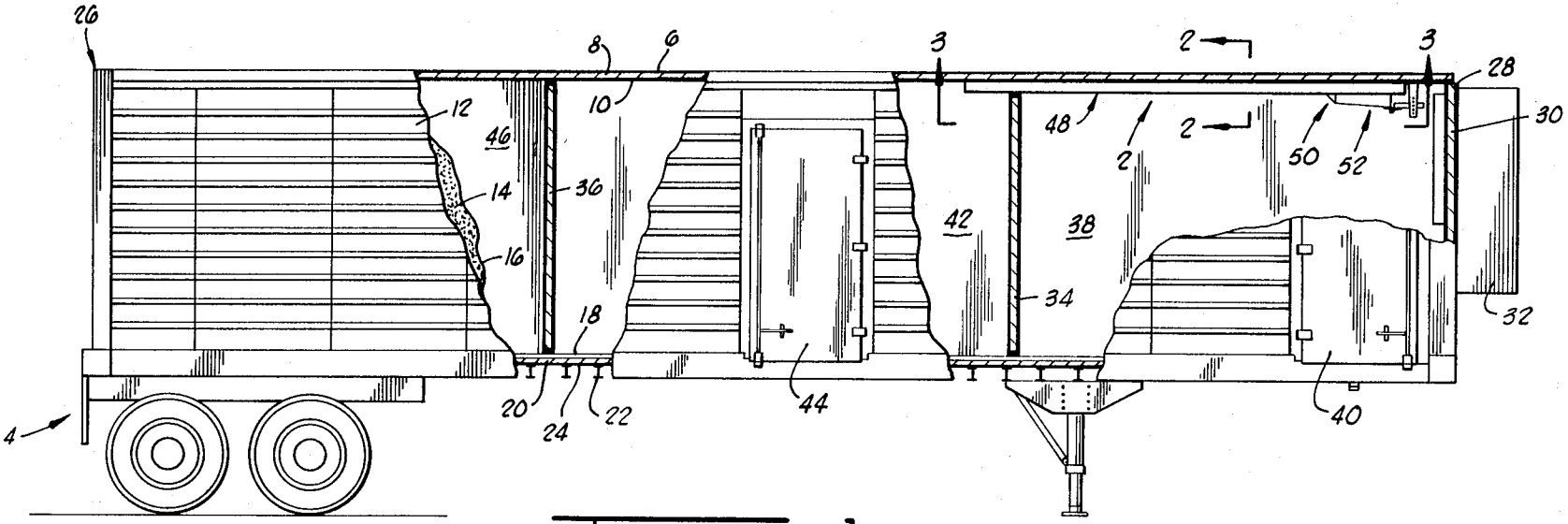
FIG. 1 is a partially sectioned side elevational view of a compartmented semitrailer having the preferred embodiment of the present invention mounted therein.

With reference to the drawings, the preferred embodiment of the present invention will be described. The apparatus constructed in accordance with the preferred embodiment is generally identified in the drawings by the reference numeral 2. FIG. 1 shows the apparatus 2 mounted in a transportable body particularly illustrated as a conventional semitrailer 4 which is used for hauling both perishable and non-perishable commodities as known to the art.

The semitrailer 4 includes a roof 6 which is insulated with a suitable insulation material 8. The underside of the roof 6 and the insulation material 8 are lined with a conventional ceiling 10. The conventional ceiling 10 is a liner made of either metallic or non-metallic material as known to the art and as is suitable for the particular usage of the semitrailer 4.

The semitrailer 4 also includes side walls 12 which include an insulation material 14. The interior of the side walls 12 are lined with a suitable liner 16.

The semitrailer 4 still further includes a floor 18 which is installed over a suitable quantity of insulating material 20. Lateral structural members 22 are disposed beneath an outer lining 24 of the floor 18.

The semitrailer 4 includes a rear wall 26 in which one or more rear doors (not shown) are disposed as known to the art.

The semitrailer 4 also includes a front wall 28 which includes insulation material 30 disposed between wall liners in a manner similar to the other walls of the semitrailer 4. The front wall 28 has an opening with appropriate reinforcements as known to the art for supporting a mechanical type of refrigeration and heating unit 32 of a type as known to the art. The unit 32 provides temperature-treated air to the interior of the semitrailer 4.

The illustrated embodiment of the semitrailer 4 is divided into compartments by means of a front insulated partition 34 and a rear insulated partition 36. In this configuration the semitrailer 4 is operable as a three-compartment carrier. The partitions 34 and 36 can be moved by means of a track or other suitable means. When disposed in the three-compartment configuration shown in FIG. 1, a front compartment 38 defined between the front partition 34 and the front wall 28 is accessed by means of a door 40. A center compartment 42 defined between the front partition 34 and the rear partition 36 is accessible by means of a door 44. A rear compartment 46 is defined between the rear wall 26 and the rear partition 36 and is accessible through the rear door or doors disposed in the rear wall 26. It is to be noted that in the illustrated view the front partition 34 extends between the appartus 2 of the present invention and the floor 18 of the semitrailer 4. Each of the partitions 34 and 36 has suitable seals around the edges thereof for providing thermally sealed junctions with the adjacent portion of the apparatus 2 or the semitrailer 4 as illustrated in FIG. 1.

The interior volume of the semitrailer 4 can be divided into any desired number of compartments as known to the art. For example, both partitions 34 and 36 can be removed so that a single compartment is defined within the semitrailer 4; the partition 36 can be removed so that two compartments are defined; and additional partitions can be added to define additional compartments. For purposes of simplicity of description, the following description of the apparatus 2 will be limited to a configuration of the semitrailer 4 including two compartments defined by the single partition 34.

The apparatus 2 of the present invention includes false ceiling means 48 for providing a first passageway and a second passageway which extend, in the illustrated embodiment, between the two compartments defined on either side of the partition 34. The apparatus 2 also includes passageway control means 50 for controlling the introduction of the temperature-treated air into one of the passageways. The temperature-treated air from the unit 32 is channeled into the passageway control means 50 by an air channeling means 52. Each of these elements generally illustrated in FIG. 1 will be more particularly described with reference to FIGS. 2–4.

Figure 2:
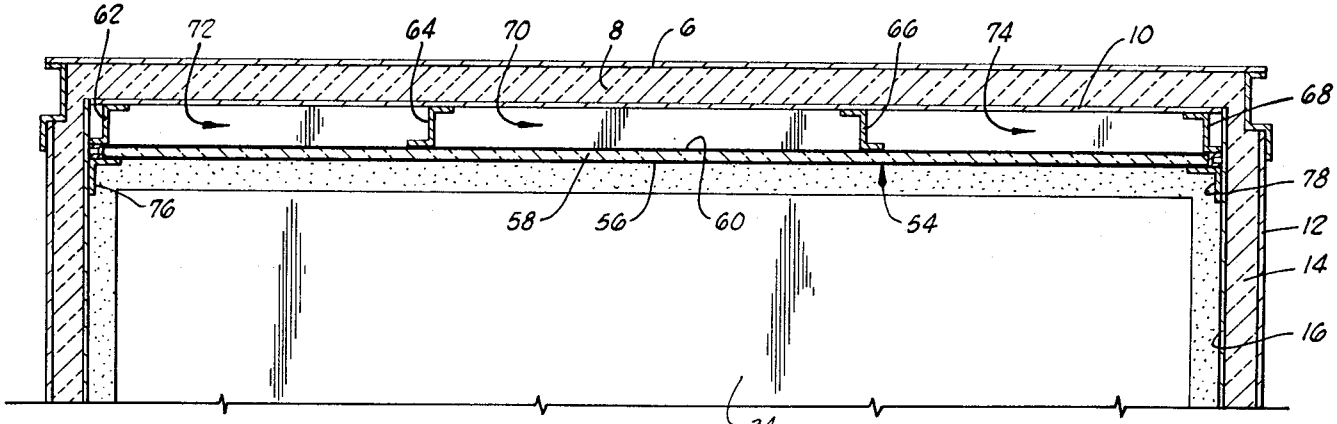
FIG. 2 is a partial end sectional view of the present invention mounted in the semitrailer, which view is taken as indicated by the line 2—2 shown in FIG. 1.

The false ceiling means 48 of the preferred embodiment includes a duct housing 54 having a plurality of ducts defined therein. As shown in FIG. 2, the duct housing 54 includes a lower liner member 56 made of a suitable metallic or non-metallic material. The lower liner member 56 forms the bottom of the false ceiling means 48 and functions as a second ceiling of the semitrailer 4 in the duct area.

Disposed above the lower liner member 56 is a layer of a suitable thermal insulation material 58. The material 58 is maintained adjacent the lower liner member 56 by an upper liner member 60 made of a suitable material. Extending longitudinally along the upper liner member 60 of the preferred embodiment are four elongated members 62, 64, 66, and 68. The elongated members 62–68 are laterally spaced from each other so that three air ducts 70, 72 and 74 are defined in side-by-side relationship by the upper liner member 60, the elongated members 62–68, and the conventional ceiling (particularly the liner 10) when the false ceiling means 48 is mounted in the semitrailer 4. As shown in FIG. 2, the duct housing 54 extends across the lateral interior distance of the semitrailer 4.

So that the apparatus 2 can be easily installed in or removed from a transportable body, the false ceiling means 48 further includes mounting means for removably mounting the duct housing 54 within the transportable body. The mounting means of the preferred embodiment includes a first angle bracket 76 which is connectible to one of the side walls of the semitrailer 4 and to the lower liner member 56 as shown in FIG. 2. The mounting means also includes a second angle bracket 78 which is connectible to the other side wall of the semitrailer 4 and to the lower liner member 56. Connection of the brackets 76 and 78 is by means of screws or other suitable connector means as known to the art.

When the false ceiling means 48 is installed in the semitrailer 4 as illustrated in the drawings, portions of the ducts are disposed in either one or the other of the compartments separated by the partition 34. It is to be noted that the partition 34 sealingly engages the smooth surface of the lower liner 56 to effect a suitable thermal seal, and the partition 34 defines which portions of the false ceiling means 48 are disposed in which compartments. Those portions of the ducts which are in the compartment 42 as shown in FIGS. 1 and 3 include an outlet 80 of the duct 70, an inlet 82 of the duct 72, and an inlet 84 of the duct 74. Disposed within the compartment 38 are an inlet 86 of the duct 70, an outlet 88 of the duct 72, and an outlet 90 of the duct 74. The outlets 88 and 90 provide exit ports through which return air flows back into the compartment 38 from the compartment 42. The outlet 88 is defined by a downwardly-facing opening 92 defined in the lower liner member 56 and an opening 94 defined at an end of the duct 72. The outlet 90 is defined by a downwardly-facing opening 96 defined in the lower liner member 56 and an opening 98 defined at an end of the duct 74. It is to be noted that in the preferred embodiment the outlets 88 and 90 are disposed farther from the compartment 42 than is the inlet 86 of the duct 70.

The duct 70 is the center duct in the preferred embodiment and provides the passageway through which the temperature-treated air flows into the compartment 42. The ducts 72 and 74 function as return air ducts by which the return air is transferred from the compartment 42 to the compartment 38 for recycling through the refrigeration or heating unit 32. So that the temperature-treated air can be properly provided to the duct 70, the apparatus 2 includes the passageway control means 50 having a preferred embodiment which will be more particularly described with reference to FIG. 4.

The passageway control means 50 includes a damper housing 100 which has an inlet and an outlet defined therein. The damper housing 100 is connected to the duct housing 54 so that the inlet and outlet of the damper housing 100 are in fluid communication with the duct 70. The inlet of the damper housing 100 is defined by an inlet structure 102. The inlet structure 102 has a height indicated by the dimension line labeled with the reference numeral 104. The outlet of the damper housing 100 is defined by an outlet structure 106. The outlet structure 106 has a height represented by the dimension line labeled with the reference numeral 108. In the preferred embodiment the height 108 is shorter than the height 104. The damper housing 100 also includes a tapered neck portion 110 connecting the inlet structure 102 with the outlet structure 106.

The passageway control means 50 also includes a damper 112 pivotally connected to the inlet structure 102 of the damper housing 100. The pivotal connection is made in the preferred embodiment about a centrally located axle 114. The damper 112 can be pivoted between a closed position wherein a flow of air is prevented from passing into the duct 70, which closed position is that shown in solid lines in FIG. 4, and an open position wherein a flow of air is permitted to pass into the duct 70 through the outlet structure 106 of the damper housing 100, which open position is shown in phantom in FIG. 4. In the preferred embodiment the damper 112 includes a support member 115 specifically shown as a flat plate. The damper 112 also includes sealing means 116 disposed along the perimeter of the support member 115 for sealingly engaging the inlet structure 102 of the damper housing 100 when the damper 112 is in its closed position. The support member 115 and the sealing means 116 have a height which is greater than the height 104 when the sealing means 116 is disengaged from the damper housing 100.

The passageway control means 50 still further includes movement means for moving the damper 112 between its open position and its closed position. In the preferred embodiment the movement means includes a solenoid 118 having a body 120 connected to the damper housing 100 and further having a piston 122 slidably disposed in the body 120 and connected by suitable means to the support member 115 of the damper 112. The piston 122 is pivotally connected to the support member 115 so that longitudinal movement of the piston 122 relative to the apparatus 2 and the damper housing 100 causes the support member 115 to pivot about the axle 114. The movement means also includes thermostat means 124 for controlling the solenoid 118 in response to the temperature detected by a temperature sensor member of the thermostat means 124. In the preferred embodiment, the temperature sensor member of the thermostat means 124 is disposed in one of the return ducts 72 or 74. In the preferred embodiment the movement means functions as a temperature-responsive means for closing the passageway provided by the duct 70 to the temperature-treated air from the unit 32 when a predetermined temperature is detected in the return air duct in which the temperature sensor member is disposed.

Figure 4:
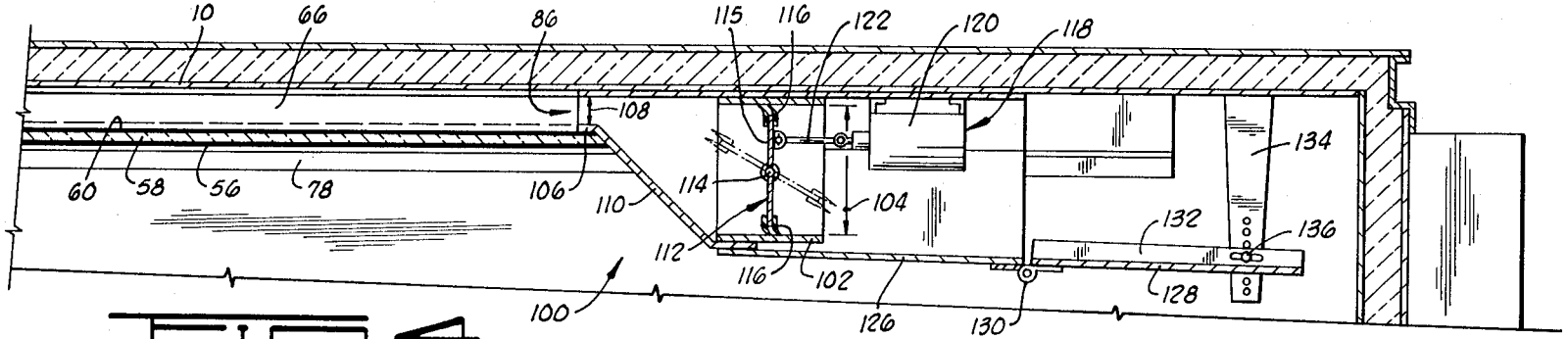
FIG. 4 is a fragmentary side elevational section view of the present invention as indicated by the line 4—4 shown in FIG. 3.
Figure 5:
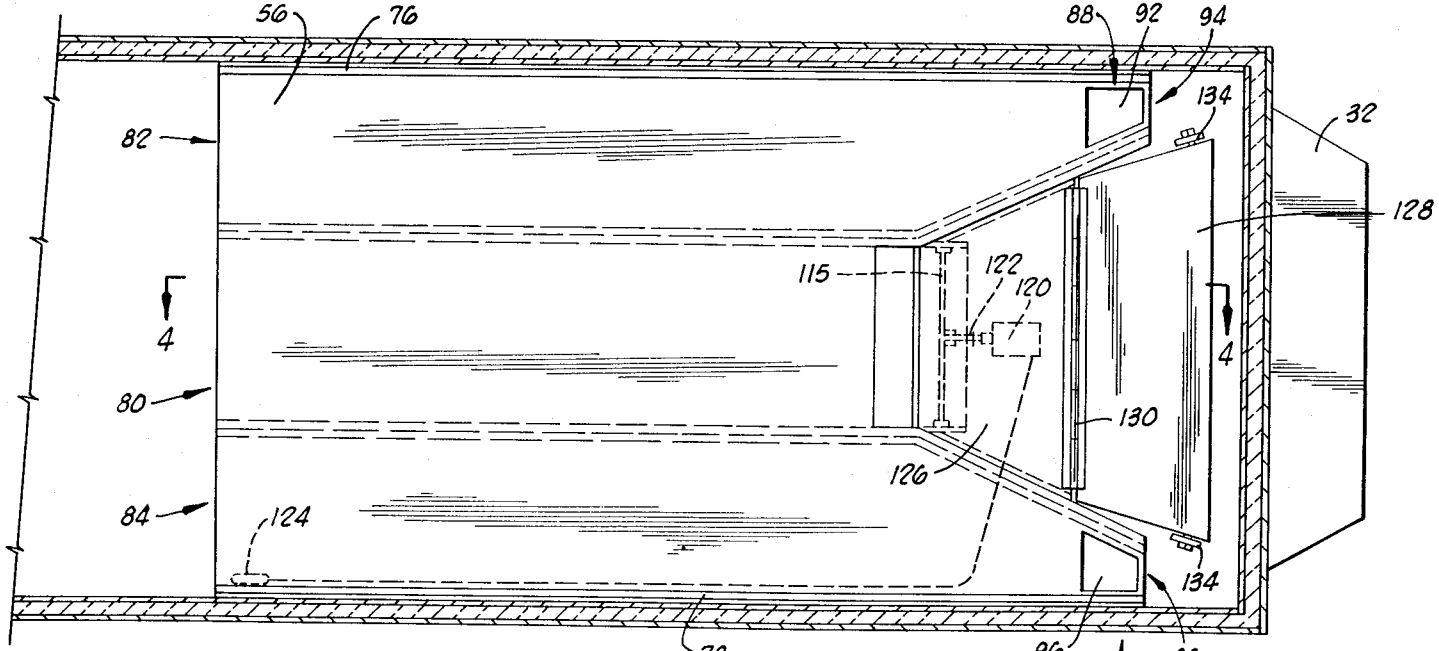

To convey at least a portion of the temperature-treated air from the unit 32 to the passageway control means 50, the apparatus 2 includes the air channeling means 52. The air channeling means 52 includes a channel member 126 connected to the damper housing 100 for providing a channel to the inlet structure 102. The channel member 126 extends substantially longitudinally outwardly from the inlet structure 102 in the preferred embodiment as shown in FIG. 4. The channel means 126 is constructed and disposed within the present invention so that the inlet structure 102 and the solenoid 118 are both contained within the air channeling volume defined by the channel member 126.

The air channeling means 52 further includes air director means for adjustably directing a flow of the temperature-treated air into the channel member 126. The air director means includes in the preferred embodiment a plate 128 pivotally connected by a hinge 130 to a lower portion of the channel member 126, which lower portion is spaced from the ceiling 10 of the semitrailer 4 and from the duct housing 54. The plate 128 extends away from the channel member 126 to a location which is beyond the ends of the duct housing 54 having the outlets 88 and 90 defined therein. The plate 128 has at least one flange 132 extending therefrom. The flange 132 has an opening defined therethrough as shown in FIG. 4. The air director means also includes a retaining member 134 which is shown connected to the lining 10 of the conventional ceiling of the semitrailer 4. The retaining member 134 has a plurality of holes defined therein. The holes are spaced longitudinally along at least a portion of the length of the retaining member 134. The air director means still further includes means for releasably securing the plate 128 to the retaining member 134 in selectable positions so that different quantities of the temperature-controlled air can be directed into the channel member 126. In the preferred embodiment the means for releasably securing the plate 128 to the retaining member 134 includes a pin 136 for holding the plate 128 adjacent the retaining member 134 with the opening of the flange 132 in alignment with a selected one of the plurality of holes of the retaining member 134. Through this cooperation of the elements of the air director means, the plate 128 can be positioned at different angles relative to the channel member 126.

When the apparatus 2 is installed in the semitrailer 4 as shown in FIG. 1, the apparatus 2 controls the flow of the temperature-treated air from the unit 32 and the compartment 38 into the compartment 42. The temperature-treated air (e.g., refrigerated air) is discharged into the compartment 38 by means of a blower which is a part of the mechanical unit 32 (such as an air conditioning or refrigeration unit). A selectable amount of this air is deflected by the plate 128 which functions as a pickup blade or scoop. The position of the plate 128 can be adjusted for the amount of air to be deflected. This adjustment is achieved by means of the adjustment pin 136 cooperating with the opening in the flange 132 and a selected one of the holes of the retaining member 134.

The air diverted by the plate 128 is directed into the channel member 126 which has a shape and configuration to funnel the air toward the inlet structure 102 of the damper housing 100. When the damper 112 is closed as shown in FIG. 4, the directed air passing through the channel member 126 cannot enter the duct 70 whereby no temperature-treated air will be distributed into the rear compartment 42. The deflected air which is blocked by the closed damper 112 spills over the sides of the plate 128 for utilization in the front compartment 38. When the rear compartment 42 requires temperature-treated air, then the solenoid 118 is activated by the thermostat means 124 so that the damper 112 is moved to its open position and the directed air from the channel member 126 is allowed to enter the duct 70 for use in the compartment 42. This operation enables the passageway control means 50 to function as a temperature-controlled shutter mechanism.

The thermostat means 124 is a suitable temperature-sensitive device which can be manually set to a desired temperature thereby providing a predetermined control once the apparatus 2 is placed in operation. This type of device is of a suitable type as known to the art.

When the temperature-treated air is allowed to flow into and through the duct 70, the air will move into the compartment 42 and circulate therethrough over the cargo contained in the compartment 42. If the air is refrigerated air, it will normally fall toward the floor 18 thereby displacing the warmer air and forcing it to flow through the return ducts 72 and 74. This warmer return air passes through the ducts 72 and 74 and flows into the compartment 38 through the outlets 88 and 90 shown in FIG. 3. This warmer air is circulated in the compartment 38 and recycled through the unit 32 so that the air is again temperature-treated and reused through the apparatus 2 of the present invention.

When the transportable body, such as the semitrailer 4, is configured as a single compartment, the apparatus 2 provides a means of enhancing the distribution of the temperature-treated air because a certain amount of the air discharged by the unit 32 is funneled by the apparatus 2 toward the center of the transportable body before being placed into the circulation cycle.

It is to be noted that the insulation 58 used in the duct housing 54 serves as a protective barrier for any commodities that come into contact with the lower liner 56. This is particularly desirable when the compartment 38 is maintained at a sub-freezing temperature whereby the diverted air coming down the duct 70 will be at a sub-freezing temperature. Because of the insulation 58, this sub-freezing temperature is not transferred through the duct housing 54 to the cargo stored in the compartment 42.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for providing temperature control to at least two compartments of a transportable body having a fixed ceiling and having means for providing temperature-treated air to the interior of said transportable body, comprising:

false ceiling means for providing a first passageway and a second passageway between at least a first one of said compartments and a second one of said compartments, said false ceiling means including:

a duct housing having a plurality of ducts defined therein; and mounting means for removably mounting said duct housing within said transportable body so that said duct housing provides a second ceiling within said transportable body below said fixed ceiling;

passageway control means, associated with an end of said first passageway which is disposed in said first one of said compartments when said false ceiling means is mounted in said transportable body, for controlling the introduction of said temperature-treated air into said first passageway; and air channeling means for adjustably channeling at least a portion of said temperature-treated air to said passageway control means.

2. An apparatus as defined in claim 1, wherein said passageway control means includes temperature-responsive means for closing said first passageway to said temperature-treated air when a predetermined temperature is detected in said second passageway.

3. An apparatus for providing temperature control to a compartment of a transportable body having a conventional ceiling and having air treatment means for providing temperature-treated air to a location within the interior of said transportable body adjacent said ceiling, comprising:

a duct housing having a plurality of ducts defined therein;

mounting means for mounting said duct housing within said transportable body adjacent said ceiling;

a damper housing, having an inlet and an outlet defined therein, connected to said duct housing for installation adjacent said ceiling so that said outlet opens into one of said plurality of ducts;

a damper pivotally connected to said damper housing;

a channel member connected to said damper housing for providing a channel to said inlet, said channel member disposed for installation adjacent said ceiling;

air director means, connected to said channel member for installation adjacent said ceiling near said location to which said temperature-treated air is provided by said air treatment means, for adjustably directing into said channel member a flow of said temperature-treated air; and movement means for moving said damper between an open position wherein said flow of said temperature-treated air passes through one of said ducts and a closed position wherein said flow of said temperature-treated air is prevented from passing through said one of said ducts.

4. An apparatus as defined in claim 3, wherein: said duct housing provides a false ceiling disposable beneath said conventional ceiling of said transportable body; and said duct housing includes:

a lower liner member;

an upper liner member;

thermal insulation material disposed between said lower liner member and said upper liner member; and four elongated members extending longitudinally along said upper liner member and being laterally spaced from each other so that three air ducts are defined by said upper liner member, said elongated members and said conventional ceiling of said transportable body when said duct housing is mounted in said transportable body.

5. An apparatus as defined in claim 4, wherein said inlet of said damper housing is connected in fluid communication with a middle one of said three ducts.

6. An apparatus as defined in claim 5, wherein:

said inlet of said damper housing has a first height;

said outlet of said damper housing has a second height shorter than said first height; and said damper has a third height greater than said first height, said damper including:

a support member pivotally connected within said damper housing between said inlet and outlet thereof; and sealing means, disposed along the perimeter of said support member, for sealingly engaging said damper housing when said damper is in its closed position.

7. An apparatus as defined in claim 6, wherein:

said three ducts include two outer ones which extend beyond said inlet of said damper housing; and said two outer ones of said three ducts have respective ends in their portions which extend beyond said inlet, said ends having return air exit ports defined therein.

8. An apparatus as defined in claim 7, wherein said air director means includes:

a plate pivotally connected to said channel member, said plate having a flange extending therefrom, said flange having an opening defined therein;

a retaining member connectible to said conventional ceiling of said transportable body, said retaining member having a plurality of holes defined longitudinally therein; and pin means for holding said plate adjacent said retaining member with said opening of said flange associated with a selected one of said plurality of holes of said retaining member.

9. An apparatus as defined in claim 8, wherein said mounting means includes:

a first bracket connectible to a first side wall of said transportable body and to said lower liner member; and a second bracket connectible to a second side wall of said transportable body and to said lower liner member.

10. An apparatus as defined in claim 9, wherein said movement means includes:

a solenoid having a body connected to said damper housing and further having a piston slidably disposed in said body and connected to said support member of said damper; and thermostat means, disposed in one of said outer ducts, for controlling said solenoid in response to the temperature detected in said one of said outer ducts.

11. An apparatus for providing temperature control to two compartments of a transportable body having means for providing temperature-treated air to the interior of said transportable body, said apparatus comprising:

a duct housing having three ducts defined therein in side-by-side relationship so that a first duct is disposed between a second duct and a third duct of said three ducts, each of said three ducts having an inlet and an outlet, said duct housing being mountable in said transportable body so that said three ducts are adjacent the ceiling of said transportable body and so that said inlet of said first duct and said outlets of said second and third ducts are disposed in a first one of said compartments and said outlet of said first duct and said inlets of said second and third ducts are disposed in a second one of said compartments;

a damper housing, including:

an inlet structure;

an outlet structure disposed in fluid communication with said inlet of said first duct; and a tapered neck portion connecting said inlet structure with said outlet structure;

a damper pivotally connected within said inlet structure;

a channel member extending longitudinally outwardly from said inlet structure of said damper housing;

air director means, connected to said channel member, for adjustably directing at least a portion of said temperature-controlled air into said channel member when said duct housing is mounted in said transportable body; and movement means for moving said damper between an open position and a closed position.

12. An apparatus as defined in claim 11, wherein said outlets of said second and third ducts are spaced farther from said second one of said compartments than is said inlet of said first duct when said duct housing is mounted in said transportable body, said outlets of said second and third ducts including respective downwardly-facing openings defined in said duct

13. An apparatus as defined in claim 12, wherein said air director means includes:

a plate pivotally connected to said channel member, said plate having a flange extending therefrom;

a retaining member connectible to said transportable body; and means for releasably securing said plate to said retaining member in selectable positions so that different quantities of said temperature-controlled air can be directed into said channel member.

14. An apparatus as defined in claim 13, wherein said movement means includes:

a solenoid having a body connected to said damper housing and further having a piston slidably disposed in said body and connected to said damper; and thermostat means, having a temperature sensor disposed in said second duct, for controlling said solenoid in response to the temperature detected by said temperature sensor.

15. An apparatus as defined in claim 11, wherein said air director means includes:

a plate pivotally connected to said channel member, said plate having a flange extending therefrom;

a retaining member connectible to said transportable body; and means for releasably securing said plate to said retaining member in selectable positions so that different quantities of said temperature-controlled air can be directed into said channel member.

16. An apparatus as defined in claim 11, wherein said movement means includes:

a solenoid having a body connected to said damper housing and further having a piston slidably disposed in said body and connected to said damper; and thermostat means, having a temperature sensor disposed in said second duct, for controlling said solenoid in response to the temperature detected by said temperature sensor.

* * * * *